US005241352A

United States Patent [19]

Lange et al.

[11] Patent Number: 5,241,352

[45] Date of Patent: Aug. 31, 1993

[54] AIR DETONED CLEANER BRUSH

[75] Inventors: Clark V. Lange, Ontario; Peter J. McGuire; Samuel P. Mordenga, both of Rochester, all of N.Y.

[73] Assignee: Xerox Corporation, Stamford, Conn.

[21] Appl. No.: 947,877

[22] Filed: Sep. 21, 1992

[51] Int. Cl.[5] ..... G03G 21/00

[52] U.S. Cl. ..... 355/301; 15/256.51; 118/652; 355/296; 355/302

[58] Field of Search ..... 355/296, 297, 298, 301, 355/302; 118/652; 15/256.51, 256.52

[56] References Cited

U.S. PATENT DOCUMENTS 3,947,108 3/1976 Thettu et al. ..... 355/297
3,957,509 5/1976 McMullen et al. ..... 355/297
4,205,911 6/1980 Dole ..... 355/298
4,295,239 10/1981 Myochin ..... 15/256.52 X
4,304,026 12/1981 Borostyan ..... 355/297 X
4,319,832 3/1982 Sakamoto et al. ..... 15/256.51 X
4,640,608 2/1987 Higaya et al. ..... 355/298 X
4,878,093 10/1989 Edmunds ..... 355/296
4,956,677 9/1990 Akiyama ..... 355/303
5,132,730 6/1992 Hurwitch et al. ..... 355/206
5,138,378 8/1992 MacDonald et al. ..... 355/208

*Primary Examiner*—A. T. Grimley
*Assistant Examiner*—Matthew S. Smith
*Attorney, Agent, or Firm*—T. L. Fair

[57] ABSTRACT

A cleaner brush in which air flow passes through the first node of the standing wave of brush fibers to facilitate removal of particles therefrom. A flexible seal maximizes the air flow through the brush fibers.

10 Claims, 3 Drawing Sheets

AIR DETONED CLEANER BRUSH

BACKGROUND OF THE INVENTION

This invention relates generally to an electrostatographic copier or printer, and more particularly, concerns a cleaning apparatus. In an electrophotographic application such as xerography, a charge retentive surface (i.e., photoconductor, photoreceptor or imaging surface) is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known, and useful for light lens copying from an original, and printing applications from electronically generated or stored originals, where a charge surface may be imagewise discharged in a variety of ways. Ion projection devices where a charge is imagewise deposited on a charge retentive substrate operates similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom.

A commercially successful mode of cleaning employed on automatic xerographic devices utilizes a brush with soft conductive fiber bristles or with insulative soft bristles which have suitable triboelectric characteristics. While the bristles are soft for the insulative brush, they provide sufficient mechanical force to dislodge residual toner particles from the charge retentive surface. In the case of the conductive brush, the brush is usually electrically biased to provide an electrostatic force for toner detachment from the charge retentive surface. Toner particles adhere to the fibers (i.e. bristles) of the brush after the charge retentive surface has been cleaned. The process of removing toner from these types of cleaner brushes can be accomplished in many ways. Typically, brush cleaners, use flicker bars to provide the detoning function.

Problems that can be associated with flicker bar detoning include: 1) damage to the cleaner brush as a result of the high impact forces at the point of contact, resulting in shorter brush lives [It has been shown that the brush life is dependent on the radius of curvature of an interfering surface. This reduced brush life with smaller radius interfering surfaces was due to an increase in brush radial shrinkage caused by an increase in permanent fiber deformation (also referred to as "fiber set") and an increase in fiber entanglement. It follows, therefore, that interfering with a surface of infinite radius (i.e. a flat surface) would provide the longest brush life.]; and, 2) higher cleaner unit manufacturing cost (UMC) due to periodic replacement or cleaning of the flicker bars.

Typically, rotary brush cleaners also encounter problems with photoreceptor filming and abrasion, and toner emissions. The filming and abrasion is due to the high impact forces that result when the brush fibers strike the toner and photoreceptor. Toner emissions usually result from inadequate or non-uniform air flow entering the cleaner at the housing to photoreceptor gaps.

The following disclosures may be relevant to various aspects of the present invention and may be briefly summarized as follows:

U.S. Pat. No. 5,138,378 to MacDonald et al. discloses a cleaning apparatus for detoning cleaner brushes. The brushes beat against the flicker bars for the release of toner carried by the brushes and for effecting suitable tribo charging of the brush fibers.

U.S. Pat. No. 5,132,730 to Hurwitch et al. discloses a cleaning apparatus for detoning cleaner brushes. The brushes beat against the flicker bars for the release of toner carried by the brushes and for effecting suitable tribo charging of the brush fibers.

SUMMARY OF INVENTION

Briefly stated, and in accordance with one aspect of the present invention, there is provided an apparatus for removing residual particles from fibers of a cleaner brush adapted to clean the residual particles from an imaging surface. The apparatus comprises a housing defining an open ended chamber having the cleaner brush rotatably mounted therein, with the housing including an inner wall that has a free end in the chamber with the fibers of the cleaner brush tangentially contacting the imaging surface and being deflected thereby so that the fibers form a first node of a standing wave in the region between the point at which the fibers disengage from the imaging surface and the free end of the inner wall. Means connected to the housing for creating air flow through at least the first node of the standing wave of the fibers moving the residual particles radially outward therefrom.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 5:
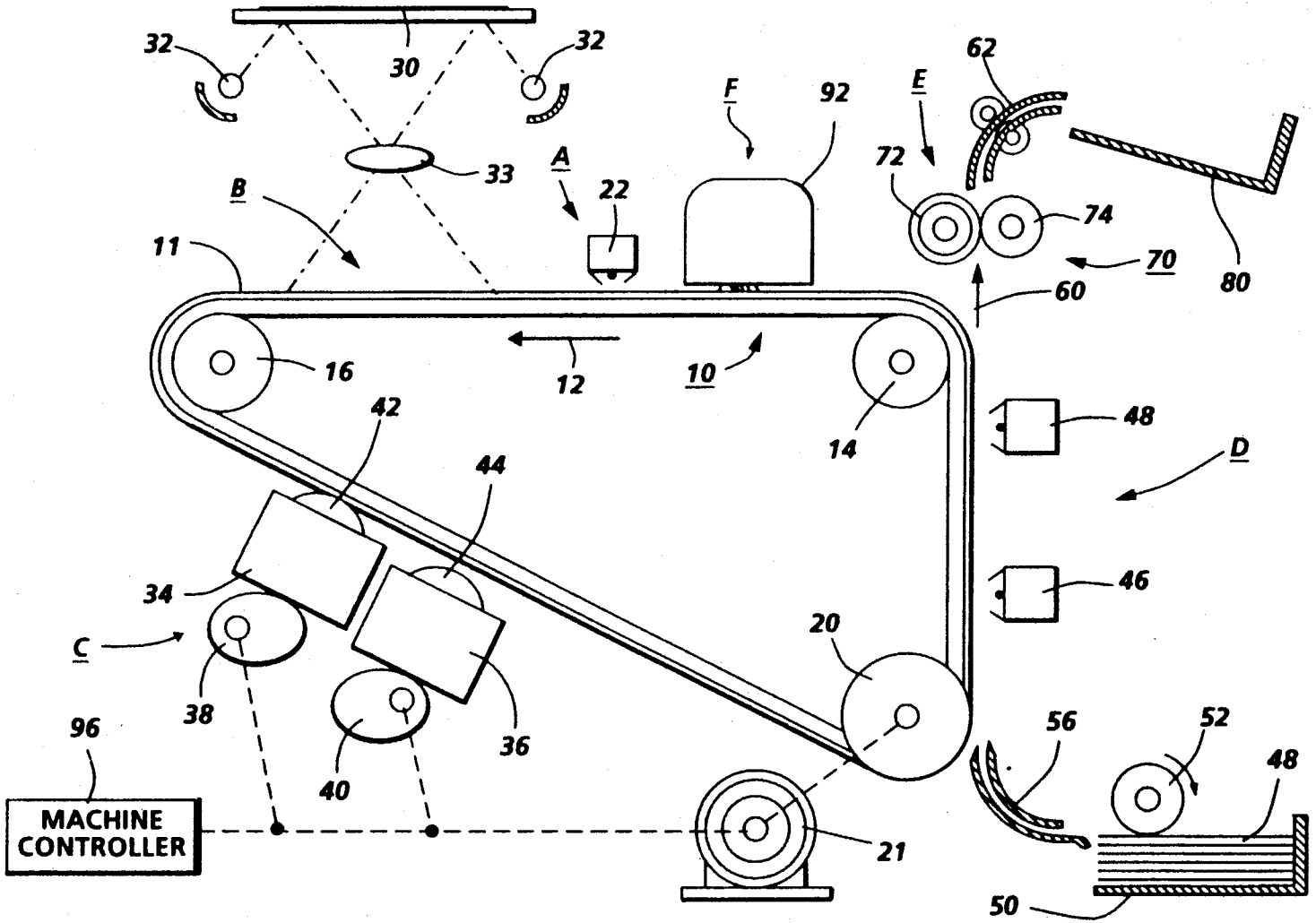
FIG. 5 is a schematic illustration of a printing apparatus incorporating the inventive features of the invention.

For a general understanding of an electrophotographic printer or copier in which the present invention may be incorporated, reference is made to FIG. 5 which depicts schematically the various components thereof. Hereinafter, like reference numerals will be employed throughout to designate identical elements. Although the air detoning cleaner brush apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 4 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 5, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to imagewise discharge the photoreceptor in accordance with stored electronic information.

Thereafter, the belt 10 advances the electrostatic latent image to development station C. At development station C, either developer housing 34 or 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 support a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet tq an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The cleaning apparatus of the present invention is represented by the reference numeral 92. Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 4 where the showings are for the purpose of illustrating preferred and alternate embodiments of the present invention and not for limiting the same.

Figure 1:
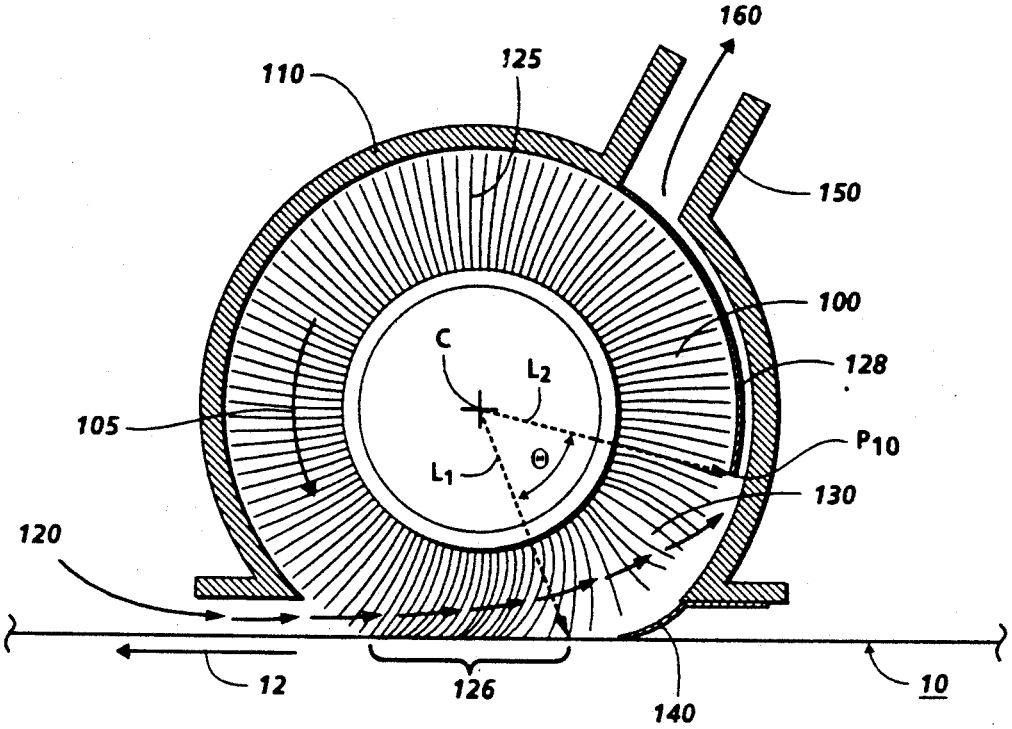
FIG. 1 shows a schematic elevational view of a preferred embodiment of an air detoning housing for a cleaner brush with an entrance lip shim.

Referring now to FIG. 1 which shows the preferred embodiment of an air detoning housing for a cleaner brush. The cleaner brush 100 rotates inside the cleaner housing 110 in the direction of arrow 105. The present invention removes the need for a conventional flicker bar by allowing the photoreceptor 10, moving in the direction of arrow 12, to act as the flicking device. In other cleaning apparatus mentioned above, the photoreceptor 10 acts to flick the brush fibers 125 after the fibers (made from thermoplastic materials such as nylon, rayon and acrylic) are released from frictional contact with the photoreceptor 10. In the present invention, the flicking action of the brush fibers 125 released from contact with the photoreceptor 10 facilitates brush 100 detoning. There are two critical elements in facilitating the present invention. First, the interior of the cleaner housing 110 incorporates a method for taking advantage of the flicking motion of the brush fibers 125 upon leaving the photoreceptor 10. This method involves setting up an angle $\theta$ which must include the first node 130 of the standing wave created by the brush fibers 125. The angle $\theta$, as shown in FIG. 1, is the angle between a line, $L_1$, formed from the center point, C, of the cleaner brush core, to the point on the photoreceptor 10, just prior to release of the brush fibers 125 from frictional contact with the photoreceptor 10, to a second line, $L_2$, that extends from the same center point, C, to a point, $P_{10}$, upstream of the cleaner brush 100 that encompasses the first node 130 of the standing wave there between. $P_{10}$ is the end point of the inside housing wall 128. In short, $\theta$ ($\theta$ ranges from 20°-80°) is defined as the dynamic response of the brush 100 after the flicking action has occurred. The standing wave phenomenon is well known and is dependent on the stiffness of the fiber and the rotational speed of the brush. (The brush rotational speed for the present invention ranges from 200 RPM-1000 RPM and the brush pile height ranges from 7 mm.-17 mm.)

With continued reference to FIG. 1, the second critical element of the present invention is that the majority of the air flow 120, created by a vacuum 160, must be directed through the brush fibers 125 at the cleaning nip 126. The cleaning nip 126 is the contact width along the photoreceptor 10 of the brush from the point where the brush fibers 125 initially make contact with the photoreceptor 10 to the point where the brush fibers 125 leave contact with the photoreceptor 10. Directing the air flow through the brush fibers is accomplished by inserting a flexible seal 140 called an Entrance Lip Shim (ELS) on the upstream side of the cleaner brush 100. The Entrance Lip Shim (made from materials such as Mylar and Tedlar and other polyurethane and polycarbonate thermoplastics) restricts the air flow 120, by preventing escape of the air between the cleaner housing 110 and the photoreceptor 10, thus, assuring that the air flow 120 will be forced through the brush fibers 125 thereby, allowing toner in and in close proximity to the brush fibers 125 to experience a component of force radially outward toward the exhaust duct 150. Example I provides a test data example of the present invention.

EXAMPLE I

Using the invention shown in FIG. 1, without a flicker bar and without the Entrance Lip Shim, but with $\theta=40°$, a brush fiber pile of 7 mm., and a brush rotational speed of about 500 RPM the cleaner brush accumulated about nine grams of toner after 10,000 high area coverage copies were made. A similar test was then run, using the same variables without a flicker bar but using the Entrance Lip Shim of the present invention. The cleaner brush only accumulated about two grams of toner after 10,000 high area coverage copies were made. Other data, using different brush designs, was collected that provided similar results.

Figure 2:
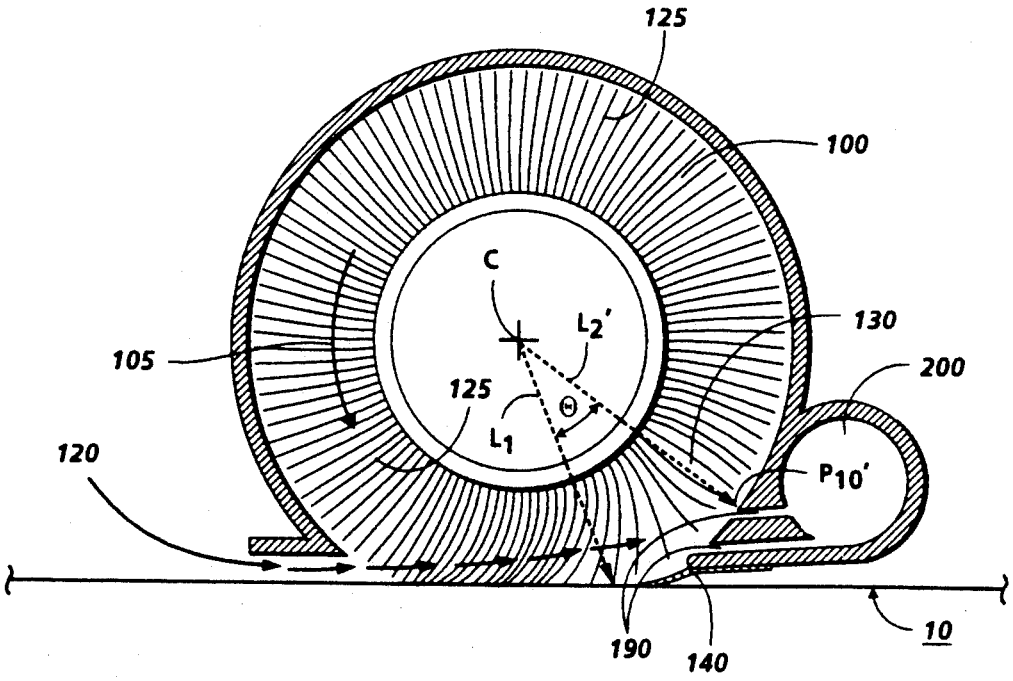
FIG. 2 shows a schematic elevational view of an air detoning housing for a cleaner brush with a dual port entrance ramp.

Referring to FIG. 2, which shows an alternate embodiment of the present invention requiring the use of a dual port 190 (upper and lower) entrance ramp of detoning air to clean toner from the brush 100 rotating in the direction of arrow 105. In this embodiment of the present invention, the use of dual port 190 takes advantage of the natural expulsion of air caused by the node 130. By positioning the air source in this region (i.e. location of the node 130), the need for flicker bars and further stress to the brush fibers 125 is eliminated. The air flow 120 in the dual ports 190 is created by the attached air duct 200. The air flow 120 is restricted by the Entrance Lip Shim (ELS) 140 in the same manner described in FIG. 1. $\theta$, is the angle measured between $L_1$ and $L_{2'}$, (similar to $\theta$ shown and described above in FIG. 1 between $L_1$ and $L_2$) with $L_{2'}$ extending from the center point, C, to a point $P_{10'}$ upstream of the cleaner brush that encompasses the first node 130. However, $P_{10'}$ is the end point of the inside housing wall of the upper of the two ports 190 at the entrance ramp of the detoning air. The other elements of the present invention shown in FIG. 2 are substantially identical to the configuration described in the preferred embodiment of FIG. 1.

Figure 3:
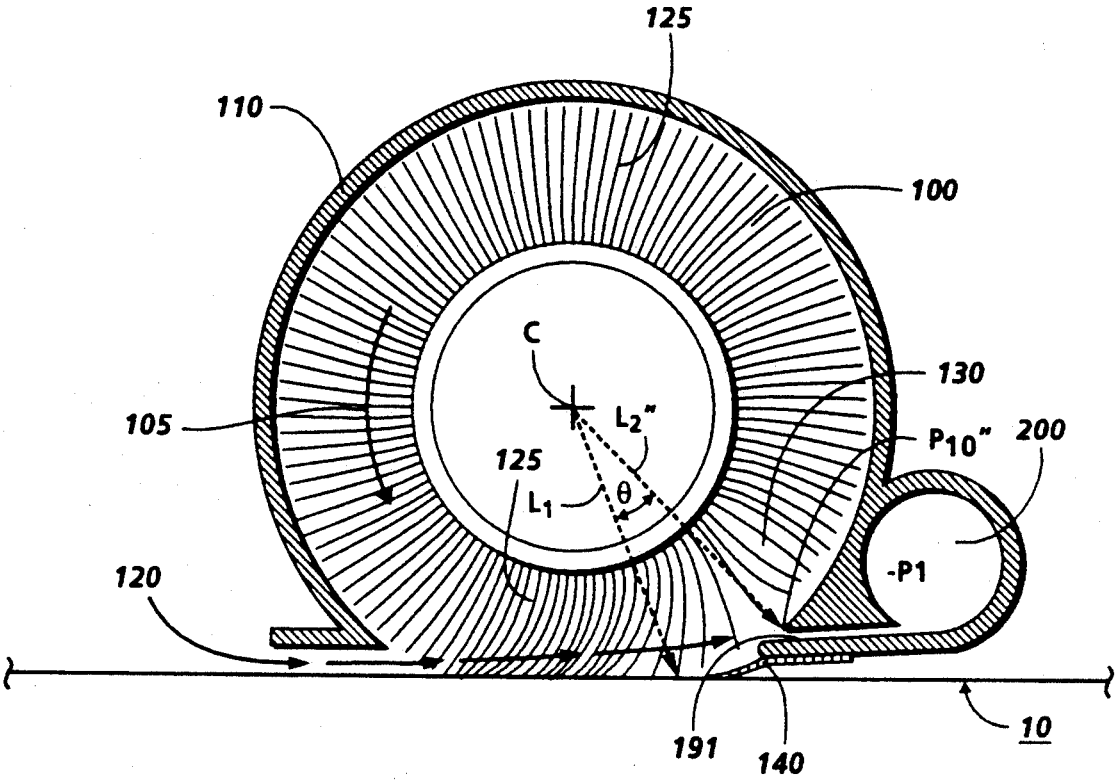
FIG. 3 shows a schematic elevational view of an alternative air detoning housing for a cleaner brush with a single port entrance ramp.

Referring to FIG. 3, which slows another embodiment of the present invention using a single port 191 entrance ramp of detoning air to clean toner from the brush 100 rotating in the direction of arrow 105. $\theta$, is the angle measured between $L_1$ and $L_{2''}$, (similar to $\theta$ shown and described above in FIG. 1 between $L_1$ and $L_2$) with $L_{2''}$ extending from the center point, C, to a point $P_{10''}$ upstream of the cleaner brush 100 that encompasses the first node 130. However, $P_{10''}$ is the end point of where the inside housing wall and the upper edge of the opening of the single port 191 meet at the entrance of the detoning air. The air flow 120 in the single port 191 is caused by the air duct 200 having negative pressure $P_1$ therein. The other elements of the present invention shown in FIG. 3 are substantially identical to the configuration described in the preferred embodiment of FIG. 1.

Figure 4:
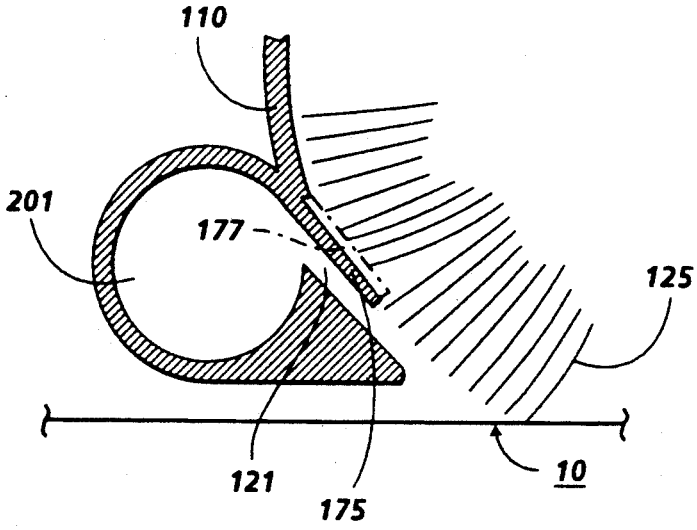
FIG. 4 shows a schematic sectional view of an alternative exit ramp for the housing that could be incorporated into FIGS. 2 and 3.

Reference is now made to FIG. 4 which shows an exit ramp that could be incorporated to the downstream side of the brush cleaner in either of the embodiments shown in FIGS. 2 and 3 of the present invention. Similar to FIG. 1, the present embodiment of the invention minimizes the impact forces to the flicking device (i.e. the photoreceptor surface 10). In this embodiment, however, reducing the fiber impact force on the photoreceptor is enabled by employing a ramp 175 at the exit side of the cleaner housing 110. While the embodiments of the present invention shown in FIGS. 2 and 3 do not require the use of an exit ramp 175, an exit ramp 175 can be used to further detone the brush fibers. Just prior to the fibers exiting from the housing 110 the fibers may encounter an exit ramp 175 or interference and a second air flow 121. This air flow 121 strips toner from the brush fiber as the air flows toward the vacuum outlet 201 at the exit ramp 175.

With continued reference to FIG. 4, a secondary purpose of the ramp 175 is to retard fiber impact on the photoreceptor. The exit ramp 175 allows for bending of the fibers 125 to prepare them for contact with the photoreceptor 10. The position of the exit ramp 175 peak is such that the fibers 125, after accelerating forward, are commencing their return swing as they meet the photoreceptor 10, thereby, minimizing the impact force on the photoreceptor 10 to reduce abrasion and impaction/filming. Measurements made during a development of the Xerox "9200F" cleaner, indicated a very high impact force when the fibers 125 first contact the photoreceptor 10. The purpose of the ramp 175 is to initiate an oscillatory motion of the fibers 125. By taking advantage of the oscillatory motion of the brush fibers 125, this impact force can be minimized. This ramp 175 could be made from various materials and even have a coating 177 (such as Teflon shown in phantom lines). The ramp material selection is based primarily on the triboelectric relationship to the brush fiber material.

In recapitulation, the apparatus for detoning a cleaner brush requires a housing that takes advantage of the flicking action, of the brush fibers, as the fibers are rotated out of frictional contact with the photoreceptor surface, to facilitate brush detoning. In order to take advantage of the flicking action of the brush fibers the standing wave phenomenon must be utilized. This requires that the first node of the standing wave be incorporated in angle $\theta$. Angle $\theta$ is defined as the angle between the distance of where the fibers leave contact with the photoreceptor and the end point of the housing inner wall free end. The first end is located at the entrance ramp of the detoning housing where maximum air flow occurs. This maximum air flow is the second key element of the present invention. A flexible seal called an Entrance Lip Shim (ELS) is placed on the upstream side of the cleaner brush to restrict the air flow created by the vacuum out of the housing. The ELS thus maximizes the air flow through the brush fibers enhancing the detoning of the brush fibers. Alternate embodiments include the use of a single or dual port detoning air stream at the entrance ramp, a coated (e.g. Teflon coated) exit ramp and/or a non-coated exit ramp.

It is, therefore, apparent that there has been provided in accordance with present invention, a cleaner brush air detoning apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from fibers of a cleaner brush adapted to clean the residual particles from an imaging surface, comprising:

a housing defining an open ended chamber having the cleaner brush rotatably mounted therein, said housing including an inner wall having a free end in the chamber with the fibers of the cleaner brush tangentially contacting the imaging surface and being deflected thereby so that the fibers form a first node of a standing wave in the region between the point at which the fibers disengage from the imaging surface and the free end of said inner wall;

means, connected to said housing for creating air flow through at least the first node of the standing wave of the fibers moving the residual particles radially outward therefrom; and a flexible seal, having one end attached to said housing, on an upstream side of the cleaner brush in the direction of movement of the imaging surface, and having the opposite end tangentially contacting said imaging surface.

2. An apparatus as recited in claim 1, wherein an angle defining an arc between the free end of said inner wall and the point at which the fibers disengage from the imaging surface, ranges from about 20° to about 80°.

3. An apparatus as recited in claim 2, wherein the cleaner brush has a rotational speed ranging from about 200 rpm to about 1000 rpm.

4. An apparatus as recited in claim 3, wherein the fibers of the cleaner brush has a pile height ranging from about 7 mm. to about 17 mm.

5. An apparatus as recited in claim 3, wherein the fibers of the cleaner brush is made from a thermoplastic material.

6. An apparatus as recited in claim 5, wherein the fibers of the cleaner brush are selected from a group consisting of nylon, rayon and acrylic.

7. An apparatus as recited in claim 1, wherein said flexible seal is made from a thermoplastic material.

8. An apparatus as recited in claim 6, wherein said thermoplastic material is selected from the group consisting of polyurethane and polycarbonate.

9. An apparatus as recited claim 1, wherein said housing defines an air outlet port coupled to the chamber thereof, further comprising an exit ramp located adjacent to the open end of the chamber upstream in the direction of movement of the imaging surface.

10. An apparatus as recited in claim 1, wherein said housing defines at least two air outlet ports, coupled to the chamber, with the free end of said inner wall, being intermediate the air outlet ports.

* * * * *